United States Patent [19]

Wynne

[11] Patent Number: 4,752,900

[45] Date of Patent: Jun. 21, 1988

[54] FOUR-QUADRANT MULTIPLIER USING A CMOS D/A CONVERTER

[75] Inventor: John M. Wynne, Dooradoyle, Ireland

[73] Assignee: Analog Devices, Inc., Norwood, Mass.

[21] Appl. No.: 864,795

[22] Filed: May 19, 1986

Related U.S. Application Data

[63] Continuation-in-part of Ser. No. 807,539, Dec. 11, 1985, abandoned.

[51] Int. Cl.[4] ..... G06J 1/00

[52] U.S. Cl. ..... 364/606; 364/602

[58] Field of Search ..... 364/606, 841, 600, 602; 307/585

[56] References Cited

U.S. PATENT DOCUMENTS 4,590,456 5/1986 Burton et al. ..... 307/585 X

*Primary Examiner*—Jerry Smith

*Assistant Examiner*—Charles B. Meyer

*Attorney, Agent, or Firm*—Wolf, Greenfield & Sacks

[57] ABSTRACT

A four-quadrant multiplier uses a CMOS digital-to-analog converter (DAC) and just one operational amplifier. The back gates of the CMOS switches in the DAC are biased in the "off" condition during a substantial voltage swing at the output of the DAC. In one embodiment, the back gates of the CMOS switches are held at about −5 V with respect to the output lines, and the logic low level to the off switch also is set at −5 V relative to the output lines. The DAC connections are "reversed" so as to receive the analog input across the terminals intended as the DAC's output, with the inputs of the operational amplifier being connected across the reference voltage terminal and a feedback or output terminal of the DAC.

11 Claims, 5 Drawing Sheets

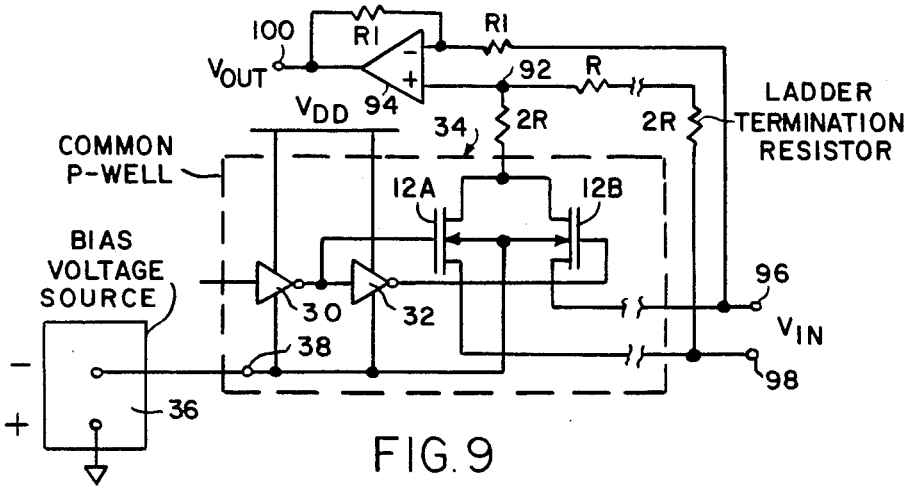
FIG. 9
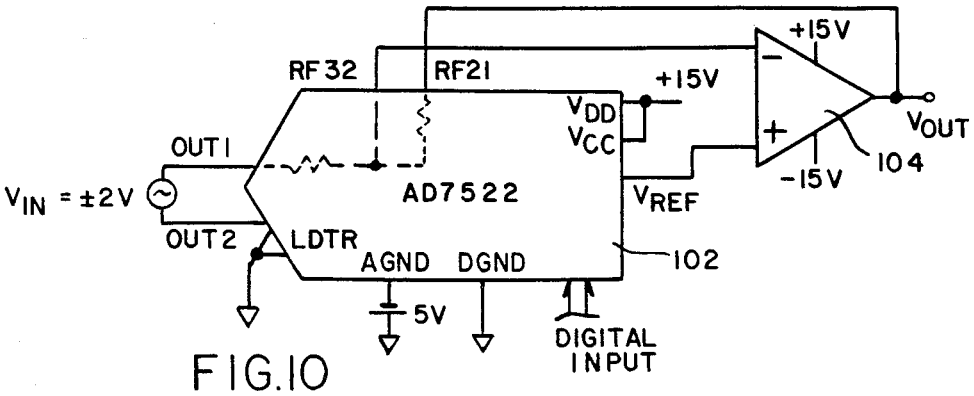
FIG. 10
FIG. 11
| DIGITAL INPUT | $V_{OUT}$ |
|---|---|
| MSB 111... 11 | $+V_{IN}(1-\frac{1}{2^9})$ |
| 111... 10 | $+V_{IN}(1-\frac{2}{2^9})$ |
| 100...01 | $+V_{IN}(\frac{1}{2^9})$ |
| 100...0 | 0 |
| 011...11 | $-V_{IN}(\frac{1}{2^9})$ |
| 011...10 | $-V_{IN}(\frac{2}{2^9})$ |
| 000...01 | $-V_{IN}(1-\frac{1}{2^9})$ |
| 000...00 | $-V_{IN}$ |

FOUR-QUADRANT MULTIPLIER USING A CMOS D/A CONVERTER

CROSS-REFERENCE TO RELATED APPLICATIONS

This application is a continuation-in-part of my prior application Ser. No. 807,539, filed Dec. 11, 1985, also titled "Four-Quadrant Multiplier Using A CMOS D/A Converter," now abandoned.

This invention is also related, broadly speaking, that disclosed in commonly-assigned U.S. Pat. No. 4,590,456, issued May 20, 1986 and titled "Low Leakage CMOS D/A Converter."

BACKGROUND OF THE INVENTION

1. Field of the Invention

This invention relates to digitally controlled analog multipliers and more particularly, to four-quadrant multipliers.

2. Description of the Prior Art

Analog multipliers are useful in a variety of applications involving, among other things, multiplication, square and square root calculations, root-sum-squares, differences of squares, trigonometric approximations, and vector sums. Frequently, multiplication is accomplished through the use of digital-to-analog converters ("D/A converters"). Four-quadrant multiplication using DAC's, however, typically requires the use of either one DAC and two operational amplifiers or two separate DAC's whose outputs are connected together in parallel, in opposite phase. The former arrangement is exemplified by the circuits of FIGS. 1 and 2. To perform four-quadrant multiplication, these circuits must multiply not only the magnitudes of the analog input signal and a digital gain factor, but also the sign of the analog input and the sign of the gain factor.

In FIG. 1, DAC 2 has a pair of outputs OUT1 and OUT2 which are complementary; operational amplifier 3 inverts output OUT2 and supplies it to a summing junction at the input of operational amplifier 4. The two operational amplifiers may introduce a differential phase shift which causes distortion in the analog output. An alternative arrangement shown in FIG. 2 employs an operational amplifier 3' to perform current-to-voltage conversion on the OUT1 current signal from the DAC. The output of op amp 3 is connected through a resistor R1 (of resistance value R1 ohms) to a summing junction at the inverting input of a second op amp 4'. The input terminal to which the input voltage Vin is applied also is connected to that summing junction through a resistor 2R1 of resistance value 2R1. The feedback resistor on op amp 4' is also of resistance 2R1. In the arrangement using two DAC's 5 and 6, illustrated in FIG. 3 at 7, the multiplier accepts a differential input voltage and produces a differential output current. The analog polarity of the output (i.e., its sign) is controlled by an analog input reference or by an offset-binary digital input word. This type of circuit is generally useful only to bipolar technology with the reference voltage being confined to a positive value; it is not readily adaptable to CMOS fabrication. Further, a common mode current is generally present at the output of such a circuit, requiring the use of a balanced load.

DAC's have been implemented in various semiconductor technologies, including CMOS. Referring now to FIG. 4, conventional DAC's of the CMOS type include a thin-film R-2R ladder network 10 which has shunt resistors connected between a terminal intended for receiving a reference voltage and N-channel CMOS switch pairs 12A, 12B; 14A, 14B; etc. The individual switches of each pair are driven by complementary signals, such that one switch of the pair is off while the other is on. The switches typically have a voltage across them of 10 mV for a 10 V reference voltage and a ladder network using 10K–20K ohm resistors. Each switch also connects to one of the output lines (e.g., OUT1 and OUT2), to connect a shunt resistor thereto when the switch is turned on.

In commonly-assigned U.S. patent application U.S. Pat. No. 4,590,456, issued May 20, 1986 and found, the three commonly-used configurations of conventional CMOS DAC's are discussed, and it is taught therein that by holding the back gates of the CMOS switches at about −200 mV (and higher than —i.e., less negative —about −500 mV) with respect to the output lines, leakage current may be substantially reduced in the output.

Referring to FIG. 5, the converter shown there has two separate output lines $I_{OUT1}$ and $I_{OUT2}$, and an analog ground line, AGND. The ladder termination resistor 16 is tied to the AGND terminal. When an all-zeros code is applied to the converter, all of the current in the R-2R ladder 10 (except for the one bit of current flowing through the ladder termination resistor to the AGND terminal) is steered to the $I_{OUT2}$ terminal. Ideally, no current should under these conditions flow to the $I_{OUT1}$ terminal. However, in practice a finite current does flow in the $I_{OUT1}$ terminal; this is known as the leakage current.

When an all-ones code is applied to the converter of FIG. 5, all of the current in the R-2R ladder (except, again, for the one bit of current through the ladder termination resistor to the AGND terminal) is steered to the $I_{OUT1}$ terminal. Any current flowing in the $I_{OUT2}$ terminal is defined as leakage current.

Referring now to FIG. 6, again there are three separate lines (or terminals) for $I_{OUT1}$, $I_{OUT2}$ and AGND. The ladder termination resistor 16 now is tied to the $I_{OUT2}$ terminal. When an all-zeros code is applied to the DAC, all of the current in the R-2R ladder is steered to the $I_{OUT2}$ terminal. Any current flowing in the $I_{OUT1}$ terminal is defined as leakage current.

When an all-ones code is applied to the converter of FIG. 6, all of the current in the R-2R ladder (except for the one bit of current flowing through the ladder termination resistor to the $I_{OUT2}$ terminal) is steered to the $I_{OUT1}$ terminal. Because of this one bit of current flowing along the $I_{OUT2}$ line, it is not possible to measure leakage current. Hence, leakage current is only defined along the $I_{OUT1}$ line for an input code of all zeros.

A slight variation appears in FIG. 7, where an $I_{OUT}$ line and an AGND* line are shown, with AGND* incorporating AGND and $I_{OUT2}$ of FIGS. 5 and 6. The ladder termination resistor 16 is tied to AGND*. When an all-zeros code is applied to the DAC, all the current in the R-2R ladder is steered to the AGND* terminal. Any current flowing in the $I_{OUT}$ line is defined as leakage current.

Leakage current, as defined above for the circuit configurations of FIGS. 5 through 7, causes errors in the digital-to-analog transfer characteristic, particularly at temperatures greater than 100° C., where the effect is most pronounced. Clearly, it is desirable to reduce such errors.

As explained in the aforesaid U.S. Pat. No. 4,590,453 the leakage currents described above actually arise from two separate components which are produced by different effects. The invention of U.S. Pat. No. 4,590,456 is directed to means and techniques for eliminating or significantly minimizing those leakage currents. Specifically, that disclosure teaches that if, in the arrangement of FIG. 8, the P-well 22 is biased negative (to about −200 mV) with respect to the $I_{OUT1}$ and $I_{OUT2}$ terminals, the bipolar transistor leakage currents ($I_2$) flowing into the $I_{OUT}$ lines are virtually eliminated. The subthreshold leakage current also is simultaneously reduced slightly because the negative bias on the P-well effectively increases the threshold voltage of the N-channel switches. It further teaches that the subthreshold leakage current is eliminated if the logic low drive to the switches 12A, 12B is biased negative by reducing an "off" gate voltage from 0 V to about −200 mV.

Additionally, that patent states that there is an upper limit on the bias voltage, of about −300 mV to −500 mV. Greater bias, it teaches, will increase the leakage to the P-well and the on-switch resistance, producing a gain error.

It is therefore an object of the present invention to provide a four-quadrant digital multiplier with an analog output (i.e., a multiplying digital-to-analog converter) requiring the use of only a single DAC and a single operational amplifier.

It is a further object of the invention to provide a four-quadrant multiplying DAC which does not introduce noticeable distortion in the analog output due to differential phase shift.

Still another object of the invention is to provide an improved four-quadrant DAC.

SUMMARY OF THE INVENTION

These objects are achieved in the present invention by the use of a single operational amplifier and a CMOS DAC. A bias source is connected to the DAC so as to apply to the back gates of the CMOS switches in the DAC a voltage (e.g., about −5 V) which is negative with respect to the OUT1 and OUT2 lines of the DAC; the logic low level to the switch which is turned off is also set at about the same negative voltage relative to the output lines. The analog input is applied to the connections of the DAC which typically would serve as its output terminals. The operational amplifier is connected differentially to the analog input and the reference input terminal of the DAC, to produce an analog output.

The invention is pointed out with particularity in the appended claims. The above and further objects, features and advantages of the invention may be better understood by referring to the following detailed description which should be read in conjunction with the accompanying drawing.

BRIEF DESCRIPTION OF THE DRAWING

In the drawing.

FIG. 9 is a circuit diagram illustrating one preferred embodiment of the present invention;

FIG. 10 is a schematic diagram of a circuit according to the invention, using an Analog Devices, Inc. AD7522 DAC; and FIG. 11 is a table showing an exemplary correspondence between a digital code input and analog output for the circuit of FIG. 10.

DESCRIPTION OF ILLUSTRATIVE EMBODIMENTS

Figure 1:
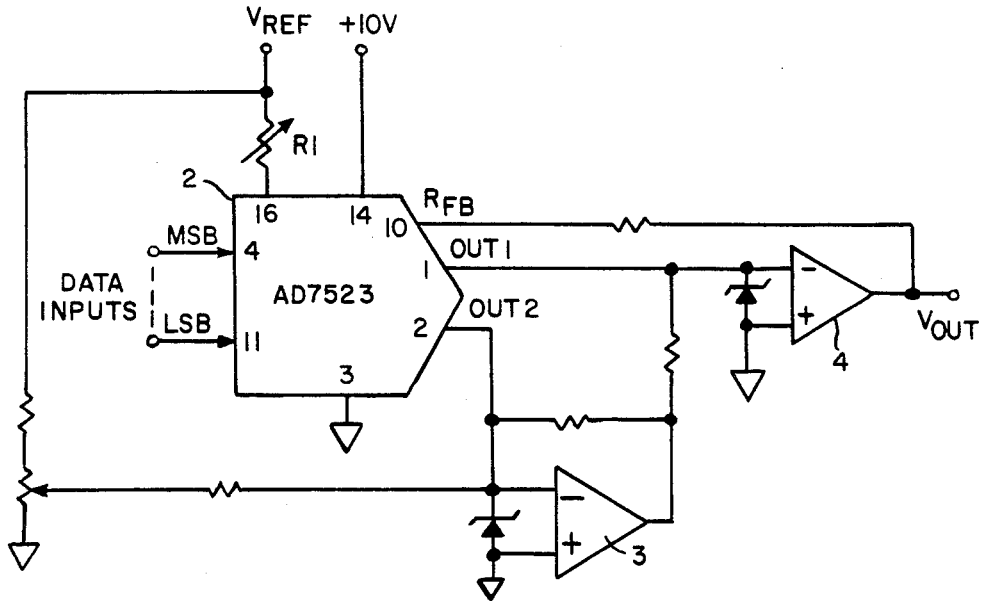
FIG.1 PRIOR ART
FIGS. 1 and 2 are circuit diagrams for prior art four-quadrant multiplying DAC's, each comprising a DAC and two operational amplifiers.
Figure 2:
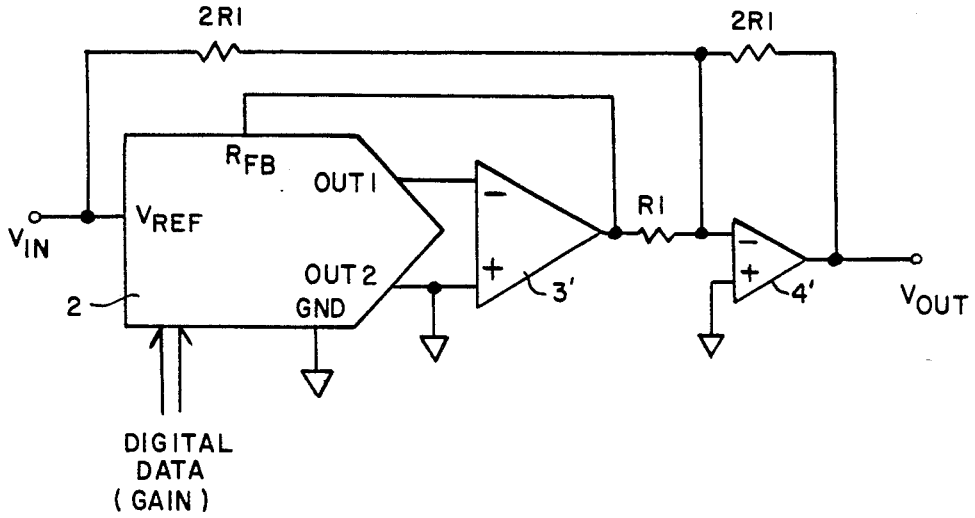
FIG.2 PRIOR ART
Figure 3:
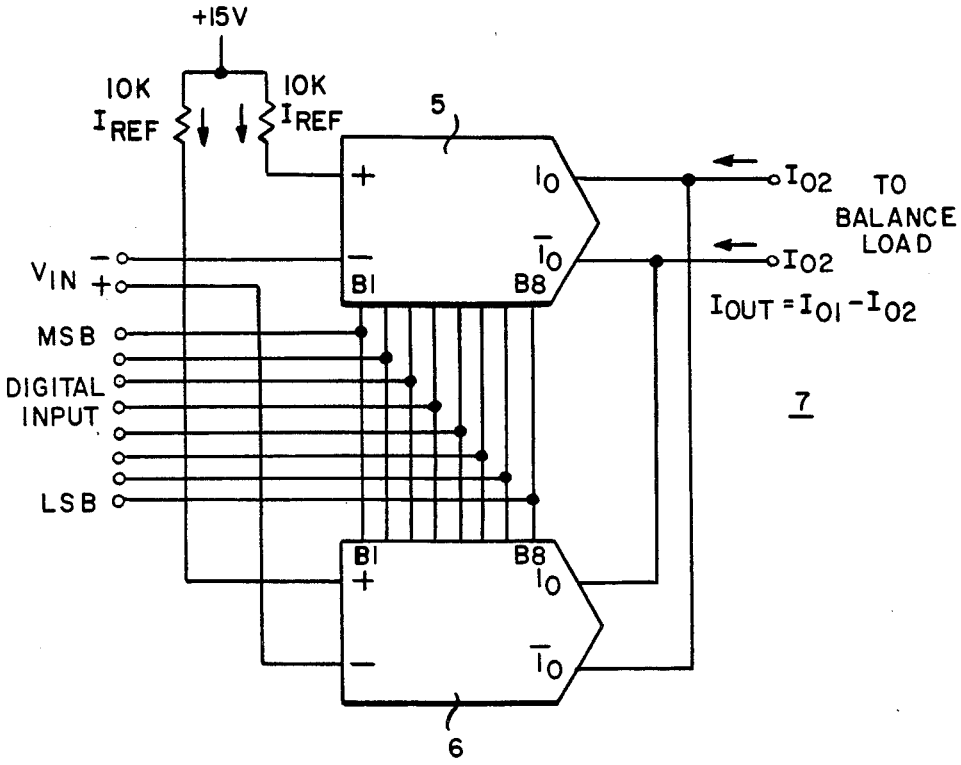
FIG. 3 PRIOR ART
FIG. 3 is a circuit diagram of a prior art four-quadrant multiplier using two DAC's.
Figure 4:
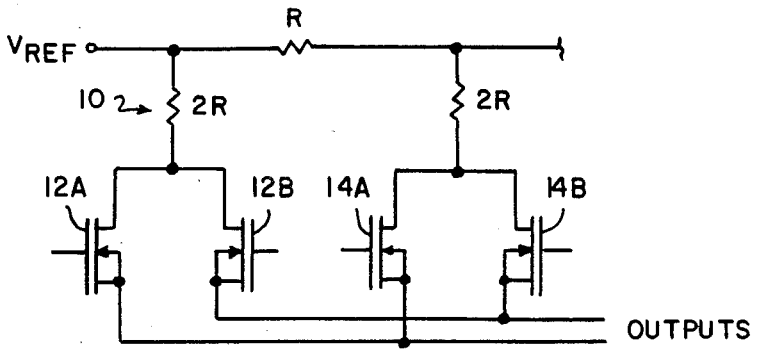
FIG.4 PRIOR ART
FIGS. 4–7 are circuit diagrams showing conventional CMOS DAC circuit configurations.
Figure 5:
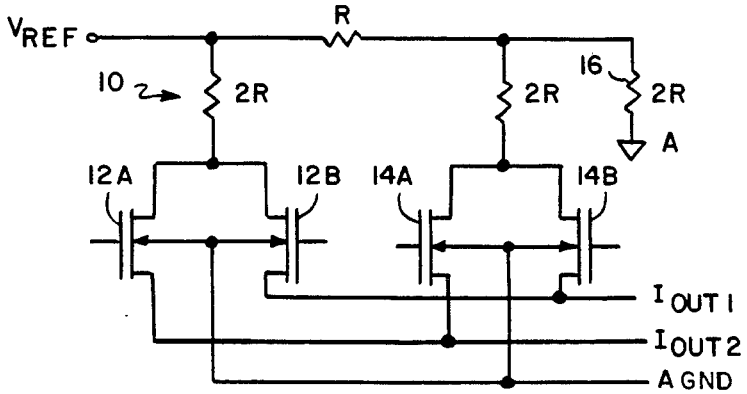
FIG.5 PRIOR ART
Figure 6:
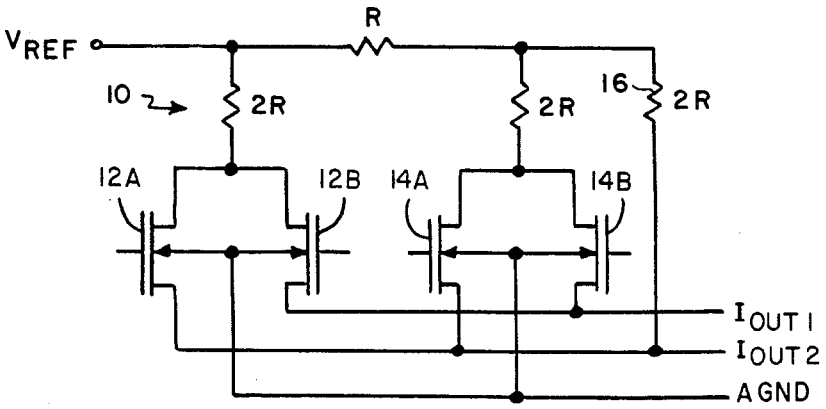
FIG.6 PRIOR ART
Figure 7:
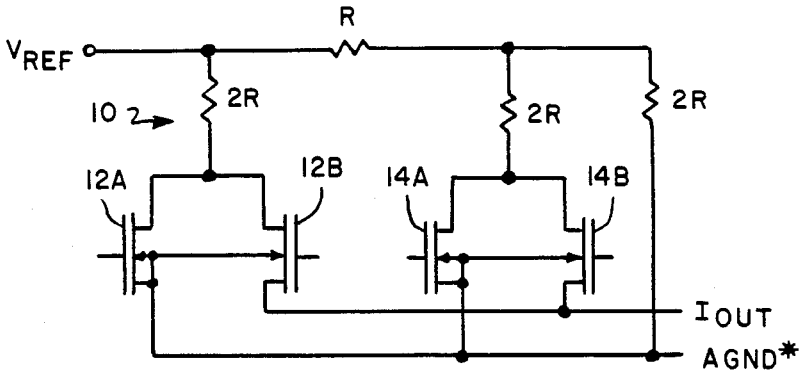
FIG. 7 PRIOR ART
Figure 8:
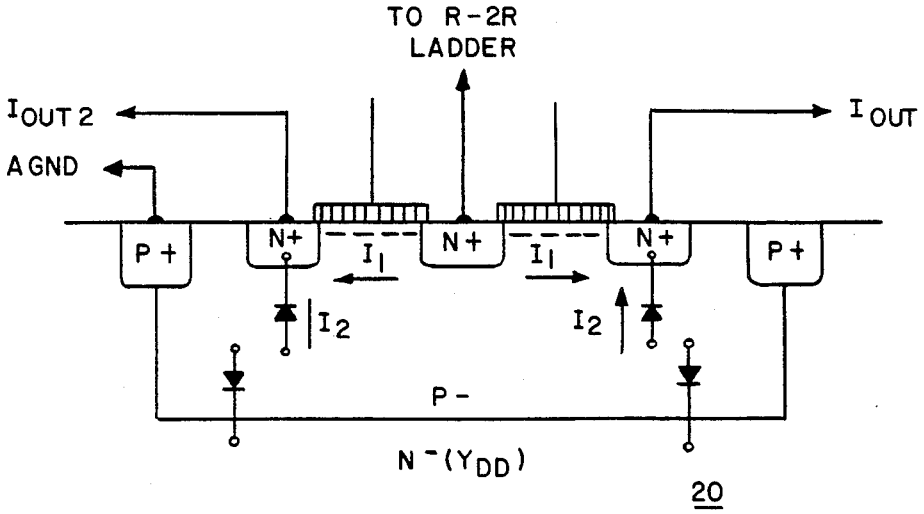
FIG. 8 is a schematic illustration of a representative arrangement of CMOS switches in a diffused integrated circuit chip.

Referring now to FIG. 9, showing one preferred embodiment of the invention, the N-channel switches 12A, 12B and the switch drivers 30, 32 are placed in a common P-well generally indicated at 34 (e.g., corresponding to P-well 22 in FIG. 7). This common P-well is maintained at a negative potential (e.g., about −5 V), as by means of a bias voltage source 36 connected to the well terminal 38.

The node 92, which normally would have been the DAC reference voltage input terminal, is connected to the non-inverting input of op-amp 94. The analog input voltage is applied to terminals 96 and 98, which for a DAC would be the OUT1 and OUT2 terminals, respectively. Terminal 96 is connected to the inverting input of op-amp 94 through a series resistance R1. Another resistance R1 is connected as a negative feedback resistor around op-amp 94. The multiplier output appears at terminal 100.

An exemplary circuit for the bias voltage source 36 is shown in U.S. Pat. No. 4,590,456, the disclosure of which is hereby incorporated by reference. Some modifications are required in that source to achieve a −5 V bias, but such modifications will be obvious to electrical engineers.

The size of the negative bias potential applied to the well depends on two things. First, it must be at least as negative as the most negative input signal to be applied to the OUT1 terminal. Second, an upper limit to the magnitude of the bias voltage is established by the parameters of the process and the N-channel MOS switch transistor design. As the bias voltage on the P-well increases, the threshold voltage of the switch transistor increases due to a phenomenon called the "body-effect." At some magnitude of bias voltage, the threshold voltage has increased to such a value that the "on" transistors are turned off. At this point, converter operation has stopped. For the four-quadrant multiplication operation to work, it is necessary that the magnitude of the bias voltage be kept below that magnitude at which the "turn-off" phenomenon occurs. Experimentation has shown that a negative bias of about −5 V is suitable to meet all of these requirements.

The model AD7522 DAC from Analog Devices, Inc., Norwood Mass., is an example of a DAC which lends itself nicely to this application. The AD7522 not only makes available the P-wells via the AGND terminal, but also provides internally feedback resistors to be used as gain selection resistors for the operational amplifier used in the multiplier. A suitable arrangement using the AD7522 DAC (102) is shown in FIG. 10. Note that the analog input voltage, $V_{IN}$, is imposed on the OUT1 and OUT2 terminals which traditionally were used as the DAC outputs. The output voltage $V_{OUT}$ of the operational amplifier 104 is given by the following relationship:

$$V_{OUT} = -V_{IN} + 2DV_{IN},$$

where D is a fraction from 0 to 1023/1024. A code table showing the correspondence between digital input and analog voltage output is given in FIG. 11.

Using the arrangement of FIG. 10, it has been determined that with a bias of −5 V on the AGND lead, a sine wave of +/−2 V amplitude can be applied to the OUT1 lead with respect to system ground. It has also been found that the bias on the AGND lead should be kept below about 6 volts magnitude; otherwise the converter operation may stop, as explained above.

Although two preferred embodiments of the invention have been disclosed herein in detail, it is to be understood that this is for the purpose of illustrating the invention, and should not be construed as necessarily limiting the scope of the invention, since it is apparent that many changes can be made by those skilled in the art while still practicing the invention claimed herein.

What is claimed is:

1. A four-quadrant multiplier for receiving an analog input signal and generating therefrom an analog output signal the amplitude of which varies with the analog input signal, and a gain factor determined by a digital gain-controlling word, the multiplier comprising:

(a) a CMOS digital-to-analog converter (DAC) having at least one switch-pair in a common well, the individual switches of such pair being complementarily driven to "on" and "off" conditions respectively, to switch a corresponding resistance network terminal to one or the other of a pair of output terminals normally intended for supplying an analog output signal therefrom in accordance with the state of an input bit, each switch having a driving gate and a back gate;

(b) the DAC further having a first feedback terminal for receiving a feedback voltage signal, a second feedback terminal operatively connected to the first feedback terminal to provide a scaled counterpart of the feedback signal, a reference voltage input terminal, and digital input terminals for receiving said gain-controlling word;

(c) the analog input signal to the multiplier being applied to the output terminals of the DAC;

(d) an operational amplifier having first and second inputs and an output, the output of the operational amplifier being connected to the first feedback terminal of the DAC, a first input of the operational amplifier being connected to the reference voltage input terminal of the DAC, and the second input of the operational amplifier being connected to the second feedback terminal of the DAC; and (e) bias means connected to develop a predetermined potential difference between the output lines of the DAC and the common well, with said common well being biased to a voltage more negative than said output terminals, the potential difference therebetween being sufficient to bias in the off condition the back gates of the switches during a substantial voltage swing at the DAC output terminals.

2. The four-quadrant multiplier of claim 1 wherein the potential difference is about 5 volts.

3. The four-quadrant multiplier of claim 1 wherein the bias means is operable to bias the well negative with respect to analog ground, to bias the switch back gates correspondingly.

4. A four-quadrant multiplier for receiving an analog input signal and generating therefrom an analog output signal, the amplitude of which varies with the analog input signal, and a gain factor determined by a digital gain-controlling word, such multiplier comprising:

(a) a CMOS digital-to-analog converter (DAC), having at least one switch-pair in a common well, the individual switches of such pair being complementarily driven to "on" and "off" conditions respectively, to switch a corresponding resistance network terminal to one or the other of a pair of DAC output terminals normally intended for supplying an analog output signal therefrom in accordance with the state of an input bit, each switch having a driving gate and a back gate;

(b) the DAC, further having a reference voltage input terminal and digital input terminals for receiving the bits of said digital gain-controlling word;

(c) the analog input signal of the multiplier, being applied to the output terminals of the DAC;

(d) an operational amplifier, having first and second inputs and an output, the output of the operational amplifier being connected to receive the analog input signal to the multiplier and further being connected through a resistor to a first input of the operational amplifier, a second input of the operational amplifier being operatively connected to the reference voltage input terminal of the DAC;

(e) a second resistor connected between the analog input signal and the first input terminal of the operational amplifier; and (f) bias means connected to develop a predetermined potential difference between the analog ground of the DAC and the common well, with said common well being biased to a voltage more negative than the output terminals of the DAC, with a potential difference therebetween sufficient to bias in the "off" condition the back gates of the switches during a substantial voltage swing at the DAC output terminals.

5. The four-quadrant multiplier of claim 4, wherein the potential difference is about 5 V.

6. The four-quadrant multiplier of claim 4, wherein the bias means is operable to bias the well negative with respect to analog ground, to bias the switch back gates correspondingly.

7. The four-quadrant multiplier of claim 4, wherein the first and second resistors are of equal resistance value.

8. The four-quadrant multiplier of claim 4, wherein the second input terminal of the operational amplifier is the non-inverting input terminal thereof.

9. A four-quadrant multiplier for receiving an analog input signal and generating therefrom an analog output signal, the amplitude of which varies with the analog input signal and a gain factor established by a digital gain-controlling word, the sign of the analog output signal varying with the sign of the analog input signal and a digital sign-controlling bit, such multiplier comprising:

(a) at least one CMOS switch-pair in a common well;

(b) means for complementarily driving the individual switches of such switch-pair to "on" and "off" conditions respectively;

(c) a resistance network connected between a resistance network terminal and a first electrode of each switch in said switch pairs;

(d) a second electrode of a first switch in each said switch-pair being connected to a first analog signal input terminal and a second electrode of the second switch in each switch-pair being connected to a second analog signal input terminal;

(e) each switch comprising a CMOS transistor having a driving gate and a back gate;

(f) the means for driving the switches being adapted to control the voltage applied to the driving gate and the back gate of each such transistor;

(g) an operational amplifier having a noninverting input connected to the resistance network terminal and an inverting input operatively connected to receive the analog input signal; and (h) a feedback resistor interconnecting the output of the operational amplifier and its inverting input.

10. The four-quadrant multiplier of claim 9, wherein the inverting input terminal of the operational amplifier is connected through a resistor to the first analog input signal terminal.

11. The four-quadrant multiplier of claim 10, wherein the feedback resistor and the resistor between the operational amplifier's inverting input terminal and the analog signal input terminal are of approximately equal resistance.

* * * * *